US009506276B2

(12) United States Patent
Rasel et al.

(10) Patent No.: US 9,506,276 B2
(45) Date of Patent: Nov. 29, 2016

(54) CLOSING DEVICE FOR VEHICLE FLAP, METHOD FOR THE ASSEMBLY OF A FLAP ARRANGEMENT

(75) Inventors: Wolfgang Rasel, Rudesheim (DE); Gregor Zoledzki, Trebur (DE); Peter Kahler, Nierstein (DE); Hans Geiser, Niedergailbach (DE); Heiko Dietrich, Darmstadt (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 297 days.

(21) Appl. No.: 13/346,757

(22) Filed: Jan. 10, 2012

(65) Prior Publication Data

US 2012/0175895 A1 Jul. 12, 2012

(30) Foreign Application Priority Data

Jan. 11, 2011 (DE) ..... 10 2011 008 324

(51) Int. Cl.

| | |
|---|---|
| ***E05F 5/06*** | (2006.01) |
| ***E05B 85/04*** | (2014.01) |
| ***E05B 17/00*** | (2006.01) |
| ***E05F 1/10*** | (2006.01) |

(52) U.S. Cl.

CPC ..... *E05B 85/045* (2013.01); *E05B 17/0037* (2013.01); *E05F 1/105* (2013.01); *E05Y 2900/532* (2013.01); *Y10T 292/1023* (2015.04)

(58) Field of Classification Search

CPC ... E05B 17/0037; E05B 85/045; E05F 1/105
USPC ..... 16/85, 86 R, 86 A
See application file for complete search history.

(56) References Cited

U.S. PATENT DOCUMENTS

| | | | | |
|---|---|---|---|---|
| 776,178 | A * | 11/1904 | Guedeney | 292/60 |
| 1,206,038 | A * | 11/1916 | De Witt | 188/31 |
| 1,875,453 | A * | 9/1932 | Haskins | 16/86 B |
| 1,990,775 | A * | 2/1935 | Croll et al. | 16/85 |

(Continued)

FOREIGN PATENT DOCUMENTS

| | | | |
|---|---|---|---|
| DE | 2950829 | A1 | 6/1981 |
| DE | 19732999 | A1 | 2/1999 |
| DE | 102006012726 | A1 | 9/2007 |
| DE | 102007038951 | A1 | 2/2009 |
| DE | 102009021611 | A1 | 11/2010 |
| EP | 0322266 | A1 | 6/1989 |

OTHER PUBLICATIONS

UK IPO, British Search Report for Application No. 1120181.1, dated Mar. 19, 2012.

German Patent Office, German Search Report for Application No. 102011008324.3, dated Aug. 24, 2011.

*Primary Examiner* — Kristina Fulton
*Assistant Examiner* — Thomas Neubauer
(74) *Attorney, Agent, or Firm* — Lorenz & Kopf LLP

(57) ABSTRACT

A closing device pivots on a vehicle body between a closing position and an opening position, such as a rear flap of a motor vehicle, with a closing element on the body side and an opposite closing element on the flap side for locking and unlocking the flap and with at least one ejection element. A plunger can be moved in a guide at least between a working position and a rest position, which upon movement into a working position can be tensioned against the force of a tensioning device. The plunger interacts with the flap for the manual opening and closing through the at least partial relaxing of the plunger. The plunger is lockable and unlockable through a locking device in a locking position in which it is tensioned at least as far as to the working position.

14 Claims, 6 Drawing Sheets

(56) References Cited

U.S. PATENT DOCUMENTS 4,198,223 A * 4/1980 Goell et al. ..... 65/391
4,779,907 A 10/1988 Yu
5,120,093 A * 6/1992 Carney ..... 292/60
5,765,882 A * 6/1998 Trauscht et al. ..... 292/1
8,292,113 B2 10/2012 Nakaya
2002/0000727 A1* 1/2002 Rass et al. ..... 292/216
2007/0245518 A1* 10/2007 Blair ..... 16/85

* cited by examiner

CLOSING DEVICE FOR VEHICLE FLAP, METHOD FOR THE ASSEMBLY OF A FLAP ARRANGEMENT

CROSS-REFERENCE TO RELATED APPLICATION

This application claims priority to German Patent Application No. 10 2011 008 324.3, filed Jan. 11, 2011, which is incorporated herein by reference in its entirety.

TECHNICAL FIELD

The technical field relates to automotive engineering, and more particularly relates to a closing device with at least one ejection element for a vehicle flap, and a method for the assembly of a flap arrangement with such a closing device.

BACKGROUND

In the industrial series production of motor vehicles, a correct position of the closing element on the body side and opposite closing element on the flap side of a closing device for locking and unlocking the flap in a closing position needed during the assembly of flaps. For example, such is needed for tailgate flaps or trunk lid flaps in order to ensure a proper operation, a flush termination with the vehicle outer skin, and an even edge gap to the adjoining body components. In practice, an adjustment of closing element and opposite closing element is carried out after the hinging of the flap on the vehicle body. The installation position of the flap is checked in the closed state. In installation position, the closing element on the body side is established in the desired position.

At least one object is provide a closing device for a vehicle flap and a method for the assembly of a flap arrangement with such a closing device, through which conventional closing devices and assembly methods are further developed in an advantageous manner. In addition, other objects, desirable features and characteristics will become apparent from the subsequent summary and detailed description, and the appended claims, taken in conjunction with the accompanying drawings and this background.

SUMMARY

A closing device is provided for a flap pivotably articulated on a body of a vehicle between a closing position and an opening position is shown. The term "flap" is to be understood in a wide sense and comprises, in general manner, any covering for a body opening pivotably hinged on the vehicle body, particularly a tailgate flap of a motor vehicle, for example, provided with a hatch back or a trunk lid. The closing device comprises a closing element on the body side and an opposite closing element on the flap side for locking and unlocking the flap in closing position. The closing element can, for example, be designed as a yoke, which can be engaged about by an opposite closing element designed as rotatable latch.

The closing device furthermore comprises at least one ejection element, which comprises at least one plunger that can be moved in a guide, particularly linear guide, at least between a working position and a rest position, which upon movement into its working position can be tensioned against the force of a tensioning means. In particular, the plunger can be moved beyond the working position against the force of the tensioning means. In the closing device, the plunger interacts with the flap so that it is moved or tensioned into its tensioned working position by closing the flap.

In addition, the flap can be brought out of the closing position into an actuating position that is different from the opening position for the manual opening and closing of the flap through at least partial relaxing of the plunger from the working position into a relaxed or at least less tensioned rest position. The at least one ejection element thus serves to bring the flap into the actuating position for a further manual opening, so that it is fundamentally distinct from an opening means, for example a gas spring, for the automatic moving of the flap into the opening position.

It is substantial here, that the plunger of the at least one ejection element can be locked and unlocked through a locking device in a locking position, in which it is tensioned at least up to the working position. In particular, the plunger can be tensioned in locking position even beyond the working position, i.e., be tensioned even more in locking position than in working position.

The closing device thus makes possible a particularly simple and reliable assembly or positioning of the flap on the vehicle body, since the at least one ejection element can be locked in installation position before the positioning of the flap and thus does not impair the closed flap or the flap brought in closing position. In this manner, a positioning of the flap in installation position with even edge gaps to adjoining body components and a flush termination of the vehicle outer skin on the series production line can be carried out quickly and cost-effectively.

With an advantageous configuration of the closing device, the latter comprises a plurality of ejection elements. Through this measure, a reduction of the tensioning force per ejection element can be advantageously achieved, as a result of which their handling and manual locking is facilitated. Since the ejection element and the locking device are exposed to lower forces by the tensioning means, the strength of the material used can be lower. In addition, the material selection is subject to fewer restrictions.

In a particularly advantageous manner, the ejection elements are arranged symmetrically with respect to the closing element more preferably arranged in the middle of the flap in vehicle transverse direction, so that the force for moving the flap from the closing position into the actuating position can be symmetrically introduced into the flap. Here, the ejection elements advantageously comprise a pressure surface each, which can interact with opposite pressure surfaces on the flap side arranged symmetrically with respect to the closing element, in order to be able to introduce the force into the flap particularly effectively. Through the symmetrical force introduction, a twisting or deforming of the flap through the plungers can be advantageously avoided. Before the background of the lightweight construction typically realized in modern motor vehicles, this measure makes possible a particularly lightweight embodiment of the flap, through which the vehicle weight can be further reduced.

The tensioning means that for loading, the plunger can be designed in a variety of ways. In a simple and cost-effective realization, the tensioning means is designed as spring element, more preferably in the shape of a coil compression spring. However, it is also conceivable in principle to produce the tensioning from an elastomer material, for example rubber, or to embody such as gas spring or piston-cylinder unit.

With an embodiment of the closing device, the plunger in its guide is received rotatably about a rotary axis. The locking device is designed as latching mechanism in such a manner that the plunger through twisting relative to the guide can be latched or unlatched. For this purpose, the plunger can for example be received in a plunger housing that serves as guide. The plunger at least a latching nose is molded, which can be brought into a rotary position by rotating the plunger, with which it engages in a latching recess of the plunger housing. This measure makes possible a particularly simple and cost-effective realization of the latching mechanism. Advantageously, the latching recess is designed so that it forms a rotation-proof latching seat for the latching nose. This anti-rotation feature allows a reliable and secure transport of the ejection elements prior to the assembly on the motor vehicle, and a secure positioning of the flap in installation position, without the risk of inadvertent detachment of the tensioned plunger. Such an anti-rotation feature of the plunger can be advantageously made possible through a positive connection with respect to the two directions of rotation of the plunger between latching nose and latching seat. Furthermore, it can be an advantage if the latching nose when moving the plunger between working position and rest position is received in a stroke recess. The stroke recess is provided with a stroke stop for limiting the stroke during the pushing-out of the plunger. In addition to the function of a locking device of the plunger, the latching nose because of this can also have a function for limiting the stroke of the plunger during the pushing-out from its guide. Therefore, material and costs can be saved. In terms of production engineering and for the assembly of the flap it can be advantageous if the plunger of the at least one ejection element is designed axially symmetrical with regard to the rotary axis, particularly in the form of a cylindrical piston. For the practical application it can be likewise advantageous if the plunger is provided with a pressure surface for the manual moving into locking position and rotary latching by means of the latching mechanism, for example by means of a thumb.

The embodiments furthermore extend to a flap arrangement of a motor vehicle with a flap pivotably hinged on a vehicle body between a closing position and an opening position, particularly a rear flap of a motor vehicle, which comprises a closing device as described above. Furthermore, a motor vehicle is provided with at least one closing device or flap arrangement as described above. In addition, the embodiments extend to an ejection element for a closing device of a flap pivotably articulated on a vehicle body between a closing position and an opening position, particularly a tailgate flap of a motor vehicle. A closing element on the body side and an opposite closing element on the flap side are provided for locking and unlocking the flap in closing position. The ejection element comprises a plunger moveable in a guide at least between a working position and a rest position, which upon movement in its working position can be tensioned against the force of a tensioning means. The plunger can be locked and unlocked through a locking device in a locking position, in which it is tensioned at least as far as to the working position.

In the method according to an embodiment, the at least one ejection element can be mounted to the vehicle body or closing device in the locked or unlocked state. In the last-mentioned case, a locking of the plunger takes place before the positioning of the closed flap in installation position.

It is to be understood that the different configurations of the subjects can be realized individually or in any combinations. In particular, the features mentioned above and still to be explained in the following cannot only be employed in the combinations stated but also in other combinations or by themselves, without leaving the scope as set forth in the claims.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
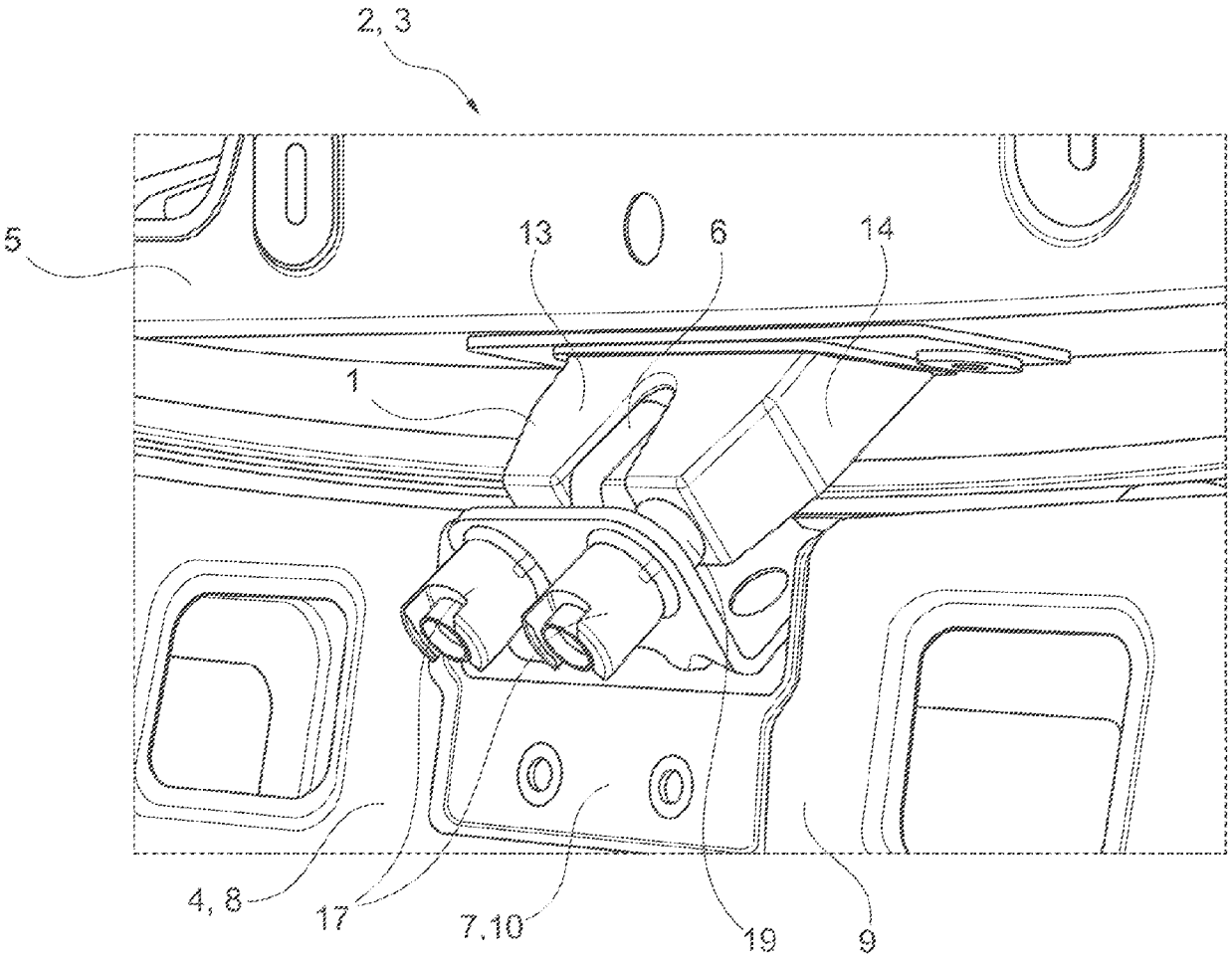
FIG. 1 is a perspective view of an exemplary embodiment of the closing device.

In the figures, a closing device altogether designated with the reference number 1 is illustrated, which is part of a flap arrangement 2 of a motor vehicle 3 with self-supporting body 4. As is shown in FIG. 1 by means of a perspective view from obliquely above, the flap arrangement 2 comprises a flap 5, which here concerns for example a tailgate flap of a motor vehicle with hatch back. Through the flap 5, a rear-end opening of the passenger compartment can be closed. The flap 5 for this purpose is pivotably hinged on an upper roof cross member (not shown) of the body 4 in the usual manner. The flap 5 can be pivoted between two end positions, namely a closing position closing the opening and an opening position opening the opening.

Figure 2:
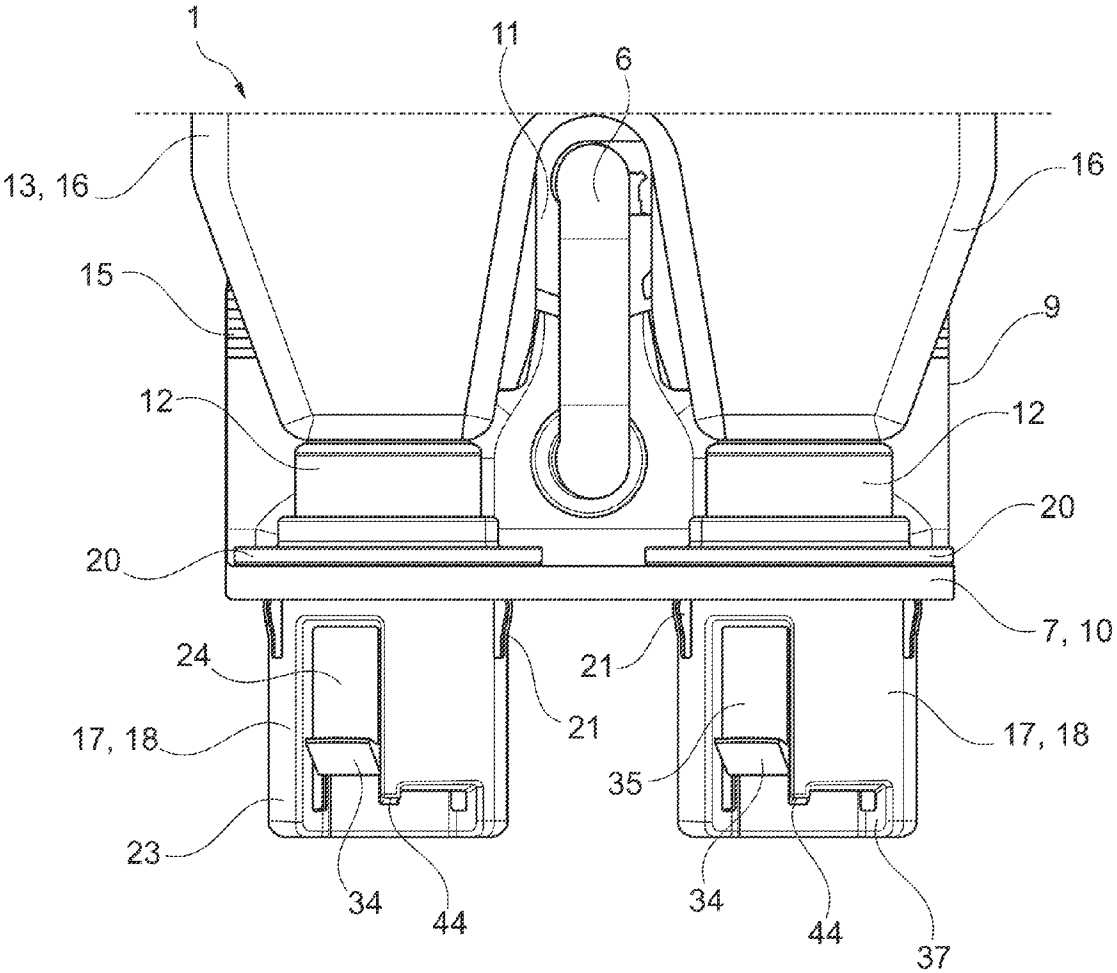
FIGS. 2-3 are further perspective views of the closing device of FIG. 1.
Figure 3:
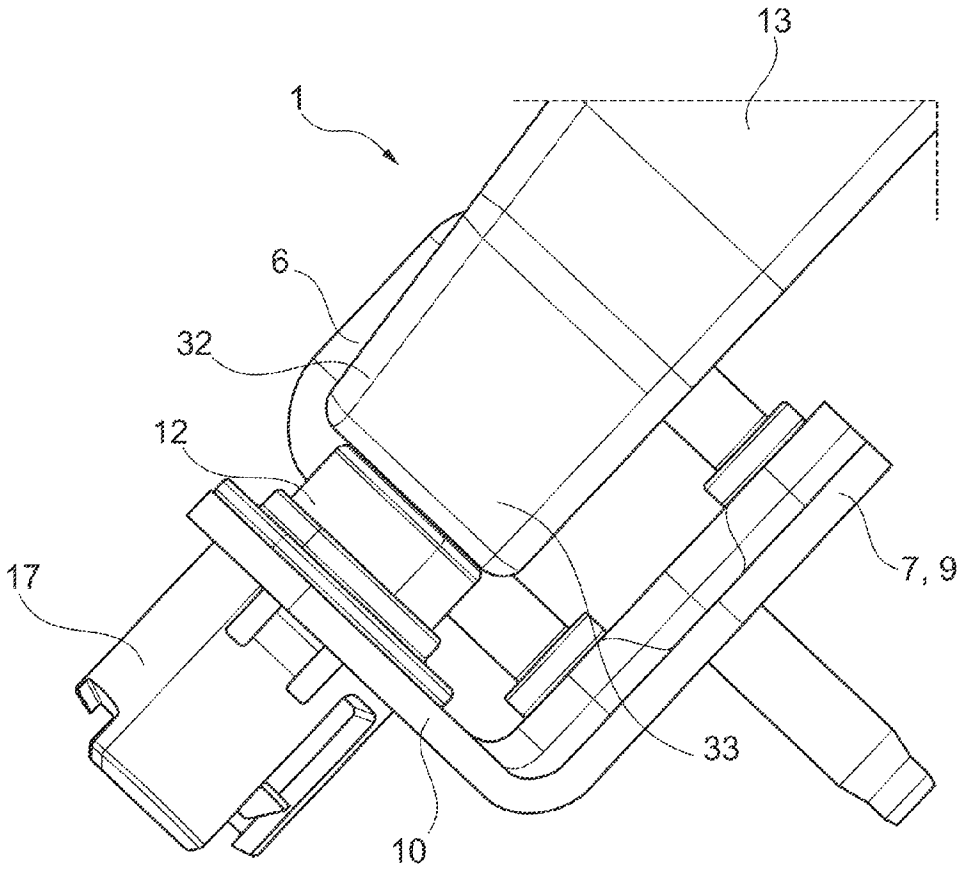

As is shown in particular in the FIG. 2 and FIG. 3 by means of perspective views from the top and from the side, the closing device 1 comprises a closing element 6 on the body side for locking or unlocking the flap 5 in closing position, which in this case is embodied as a U-shaped yoke. The closing element 6 is attached to a carrier element 7, in this case for example a plate-shaped corner angle, through screw connections or another suitable fastening technique. The closing element 6 is fastened to a first carrier plate 9 of the carrier element 7. A second carrier plate 10 of the carrier element 7 stands away from the first carrier plate 9 approximately perpendicularly. The carrier element 7 in turn is fastened to a body component 8 for example through a screw connection or another suitable fastening technique. In the embodiment, the carrier element 7 is connected to the lower body rear wall ("rear wall bottom").

The closing device 1 furthermore comprises a closing element 11 on the flap side that is functionally coupled to the closing element, which in this case is embodied for example as rotatable catch. The opposite closing element 11 is received in a lock housing 13, which on the inside is fastened to the flap 5 via a base plate 14 by means of screw connections or another suitable fastening technique. The lock housing 13 stands obliquely away from the base plate 14 towards the passenger compartment. In the closing device 1, the closing element 6 and the lock housing 13 are so arranged that the closing element 6 with closed flap 5 is located in a middle recess 15 of the lock housing 13, so that the closing element 11 can enter into locked engagement with the closing element 6. In the shown embodiment, the rotatable catch can engage about the yoke for locking the flap 5 in closing position or release said yoke again for unlocking the flap 5. Through the recess 15, the lock housing 13 forms two housing sections 16, which in closing position of the flap 5 protrude towards the second carrier plate 10 of the carrier element 7.

On the carrier element 7, two ejection elements 17 are arranged, each of which in this case have a plunger 12 in this case embodied in the shape of a cylindrical piston and a plunger housing 18. The plunger housing 18 forms a cylindrical hollow space 25, in which the plunger 12 is received displaceable in longitudinal direction. A housing inner surface 22 of the plunger housing 18 serves as linear guide for the plunger 12. The two ejection elements 17 are each fastened to the second carrier plate 10 of the carrier element 7 via the plunger housing 18. For this purpose, the second carrier plate 10 is provided with two circular break-throughs 19, each of which is penetrated by a plunger housing 18. A fastening to the second carrier plate 10 is effected by way of a ring-shaped fastening flange 20 molded onto a housing outer surface 23 of the plunger housing 18, which is fastened to the second carrier plate 10 through a conventional fastening technique such as for example screwing, welding or riveting. Through abutments 21 molded onto the housing outer surface 23, the ejection element 17 is sturdily fixed on the carrier element 7.

Figure 4C:
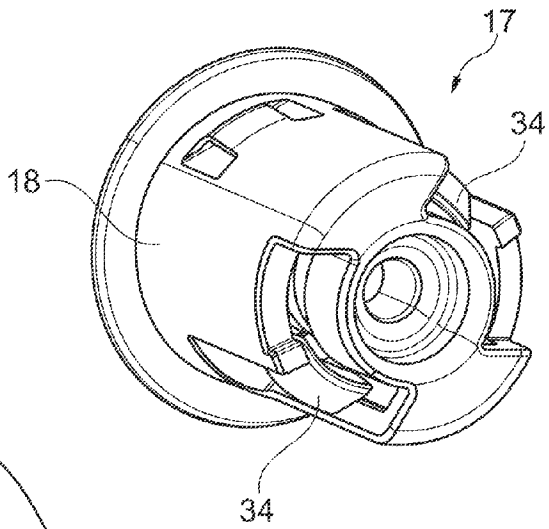
FIGS. 4A-4C are different perspective views of the ejection element of the closing device of FIG. 1.
Figure 4B:
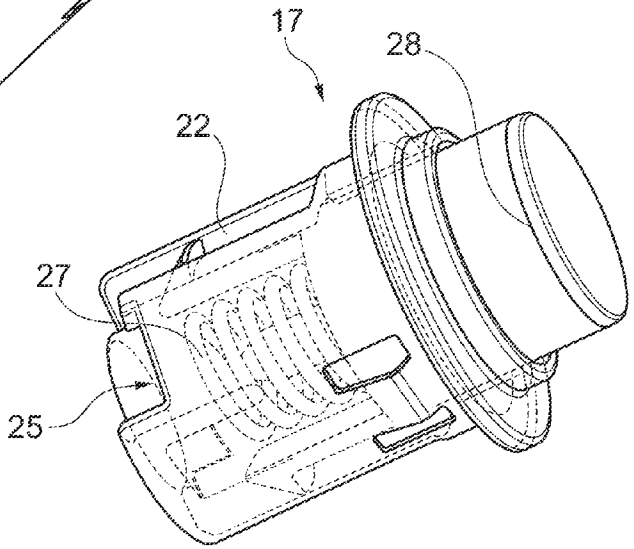
Figure 4A:
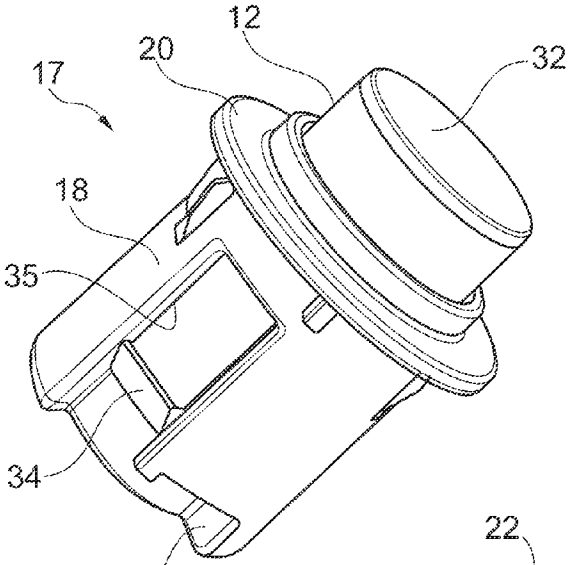
Figure 5C:
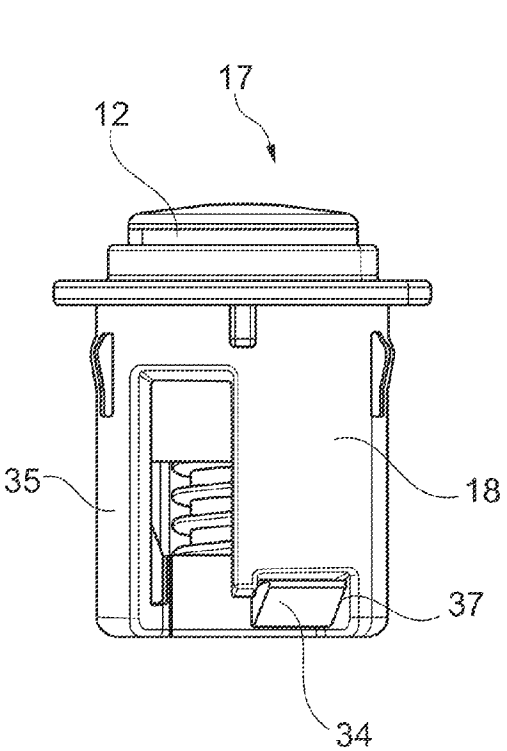
FIGS. 5A-5C are further perspective views of the ejection element of the closing device of FIG. 1, with different positions of the plunger.
Figure 5B:
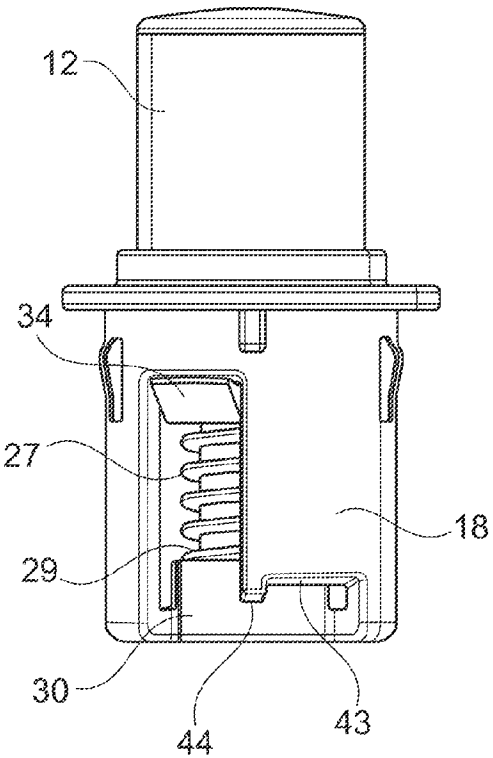
Figure 5A:
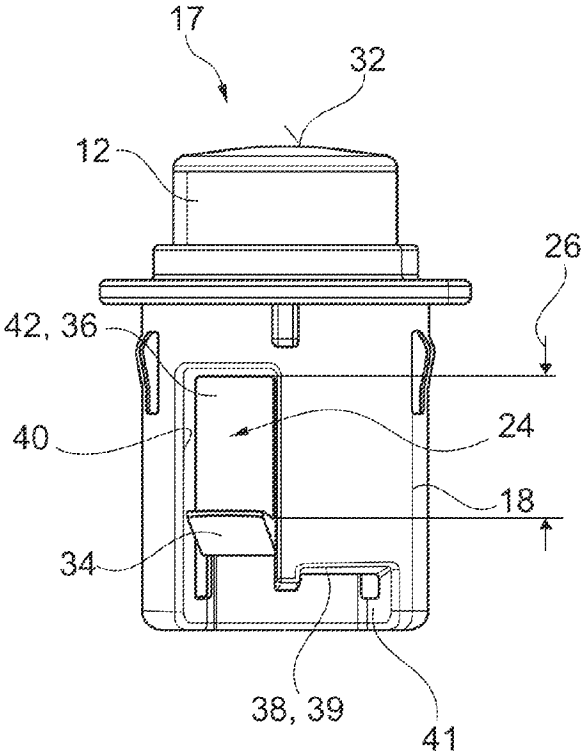

As is shown in FIG. 4*a* to FIG. 4*c*, and the FIG. 5*a* to FIG. 5*c*, by means of different perspective views of the ejection element 17 (FIG. 4*b* shows a transparent representation, FIG. 4*c* a partly sectioned representation), the plunger 12 can be displaced within the plunger housing 18 against the spring force of a coil compression spring 27. The coil compression spring 27 for this purpose is clamped with its two ends between a first pressure surface 28 and a second pressure surface 29. The first pressure surface 28 is formed by an inner surface of a terminal plunger pressure surface 32 of the plunger 12 and the second pressure surface 29 by a base 30 of the plunger housing 18. The plunger 12 in its linear guide can be tensioned against the spring force of the coil compression spring 27. The two ejection elements 17 are arranged in the flap arrangement 2 so that the plungers 12 on closing of the flap 5 are each pressed into the plunger housing 18 through the two housing sections 16 of the lock housing 13. For this purpose, the two plungers 12 are each provided with a plunger pressure surface 32 that is flat or crowned in shape at its free ends, which come to bear against the opposite pressure surfaces 33 of the housing sections 16 designed in matching shape.

FIG. 5*a* shows a situation wherein in the ejection element 17 the plunger 12 is pushed into the plunger housing 18 through the flap 5 (not shown) brought into closing position, yet still protrudes from the plunger housing 18. This position of the plunger 12 is designated tensioned "working position" in the introduction to the description. On the other hand, the unlocked flap 5 are pushed out of the closing position into an actuation position through at least partial relaxing of the two plungers 12 tensioned through the coil compression springs, upon which the plungers 12 are each moved a distance out of the plunger housing 18. In actuation position, a grip or handle (not shown) for example for the manual opening of the flap 5 becomes freely accessible, so that the flap 5 can be opened as far as to the opening position. This situation is shown in FIG. 5*b*. The position of the plunger 12 assumed thereby is designated "rest position" in the introduction to the description.

In FIG. 5A, the stroke 26 of the plunger 12 covered in each case during the automatic pushing open and, for example, manual closing of the flap 5 is shown. For the stroke limitation, a latching nose 34 molded onto a plunger outer surface 24 is provided, which is freely moveable within a longitudinal first clearance 35 of the plunger housing 18, henceforth designated "stroke clearance". The latching nose 34 on pushing out of the plunger 12 comes to bear against a stroke stop 36 formed by a first transverse edge 42, as a result of which the stroke of the plunger 12 is limited. On the other hand, the plunger 12 during the closing operation of the flap 5 is pushed into the plunger housing 18 through the opposite pressure surface 33 of the housing section 16 until the flap 5 is in closing position. The stroke 26 of the plunger 12 thus depends on the relative positioning of the two plunger pressure surfaces 32 to the opposite pressure surfaces 33. The latching nose 34 during the opening and closing of the flap 5 is always located within the stroke clearance 35.

The plunger 12 is rotatably received about a concentric rotary axis in the plunger housing 18. Through the latching nose 34 received in the stroke clearance 35 between two first longitudinal edges 40 a rotation of the plunger 12 during the opening and closing of the flap 5 is prevented. For this purpose, the latching nose 34 is fixed in rotary direction by the two first longitudinal edges 40 except for a certain play, through which a slight inward and outward movement of the plunger 12 is made possible.

By pressing on the plunger pressure surface 32 against the spring force of the coil compression spring 27, the plunger can be pressed into the plunger housing 18 even further than to the working position. Here, the plunger 12 can be more preferably pressed in so far until the latching nose 34 is located beyond one of the two first longitudinal edges 40, so that the plunger 12 can be rotated in a rotary direction. Therefore, the latching nose 34 enters into a second longitudinal clearance 37 of the plunger housing 18, henceforth designated "latching clearance", which is arranged parallel to the stroke clearance 35 and comprises two-second longitudinal edges 41, which fix the latching nose 34 in circumferential direction. A second transverse edge 43 of the latching clearance 37 forms a latching stop 38 for the latching nose 34, because of which a latching seat 39 for the latching nose 34 is formed. Since the latching nose 34 is guided about a protrusion 44 between the two clearances 35, 37 by rotating the plunger 12 and the latching nose 34 with respect to the two directions of rotation, the plunger 12 is positively received in the latching seat, and the latching nose 34 can be latched on the spring load in the latching seat 39 secured against rotation. In this manner, the plunger 12 can be latched in a position in which with respect to the working position it protrudes less far from the plunger housing 18, so that the plunger pressure surface 32 with closed flap 5 no longer has any contact with the opposite pressure surface 33 of the housing section 16. This situation is shown in FIG. 5*c*. The position of the plunger 12 assumed there, is designated "locking position" in the introduction to the description.

As already mentioned, the locking of the plunger 12 in locking position is secured against rotation through positive connection by the protrusion 44. The plunger 12 can, for example, be pressed in with the thumb on the plunger pressure surface 32 and simultaneously rotated in the one direction of rotation in order to latch the latching nose 34 in the latching clearance 37 for locking the plunger 12. In corresponding manner, the plunger 12 can be unlocked in that the plunger 12 is pressed in and rotated in the other direction of rotation, so that the latching nose 34 is moved out of the latching clearance 37 into the stroke clearance 35, which allows a stroke of the plunger 12 that is desired for utilizing the flap 5.

The locking of the plunger 12 by latching the latching nose 34 in the latching seat 39 makes possible a particularly simple, rapid and reliable positioning of the flap 5 in installation position, since the flap 5 in this manner can be brought into closing position without impairment by the ejection elements 17, in order to achieve even edge gaps to the adjoining body components and a flush termination of the vehicle outer skin. In the series production of motor vehicles, a mounting of the closing device 1 on body 4 and flap 5 as well as hinging of the flap 5 on the body 4 is carried out initially, followed by a positioning of the closed flap 5 in installation position with locked plungers 12, so that the flap 5 can be brought into the closing position in an unimpeded manner. Following the fixing of the closing device 1, the plungers 12 are unlocked again. The plungers 12 can be mounted on the body 4 in the locked or unlocked state.

Figure 6:
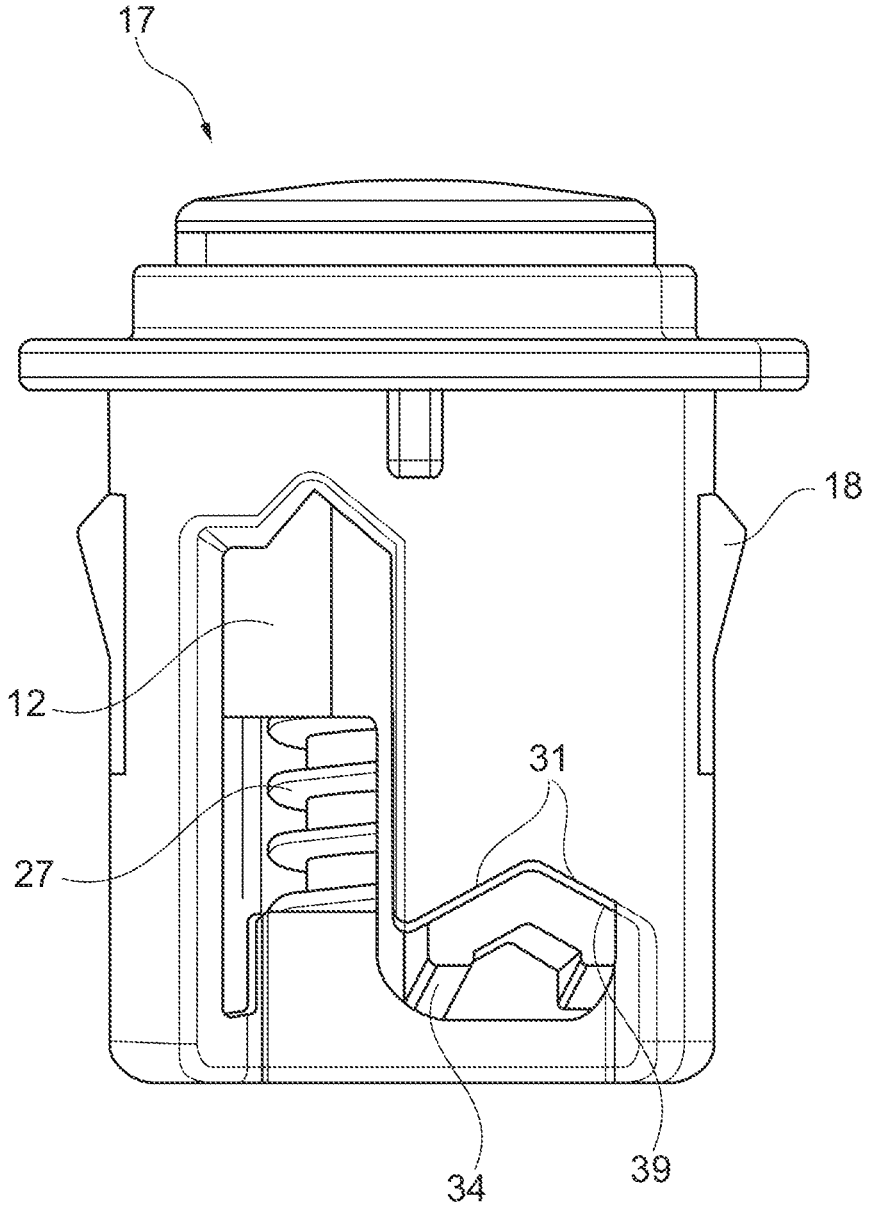
FIG. 6 is a perspective view of a variant of the ejection element of the closing device of FIG. 1 to illustrate another exemplary embodiment.

FIG. 6 shows a variant of the ejection element 17 by means of a perspective view to illustrate a further exemplary embodiment of the closing device 1. In order to avoid unnecessary repetitions, merely the differences to the previous exemplary embodiment are explained while reference is otherwise made to the explanations there.

Accordingly, the latching nose 34 is designed wedge-shaped and has two flat wedge surfaces 31 running obliquely, which are set at an obtuse angle. The latching seat 39 is suitably designed in matching shape. The protrusion 44 is part of one of the two wedge surfaces 31. The latching nose 34 can thus be positively received in the latching seat 39 in a rotationally secured manner. It is to be understood that the latching nose 34 and the latching seat 39 can also have any other suitable shape in order to form a positive connection in the two directions of rotation of the plunger 12.

In the closing device 1, the spring force of the coil compression springs 27 can be reduced through the two ejection elements 17 compared with the utilization of only one individual ejection element 17, because of which their handleability, particularly manual locking, is facilitated. The plunges 12 can for example be preloaded with a force in the range from 70 to 80 N. In corresponding manner, the plunger housing 18 only needs to have a lower strength so that the material selection is subject to lesser restrictions. The two ejection elements 17 and the plunger pressure surfaces 32 are arranged symmetrically with respect to the closing element 6 located with respect to the vehicle transverse direction at least approximately in the middle of the flap 5. In corresponding manner, the two opposite pressure surfaces 33 are arranged symmetrical to the opposite closing element 11 located within vehicle transverse direction at least approximately in the middle of the flap. This makes possible a symmetrical and particularly effective force introduction into the flap 5, so that twisting or deformation of the flap 5 can be avoided. Therefore, the flap can be embodied lighter, because of which vehicle weight and costs in the flap manufacture can be saved.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A closing device, comprising:

a vehicle body;

a flap configured to pivot on the vehicle body between a closing position and an opening position;

a first closing element configured as a yoke for attachment on the vehicle body;

a second closing element opposite the first closing element and configured for attachment on a side of the flap, the second closing element including a first housing section and a second housing section that define a recess between the first housing section and the second housing section, wherein the recess opposes the yoke, wherein the second closing element includes an engaged position to lock the flap and a released position to unlock the flap;

a first ejection element and a second ejection element disposed on opposite lateral sides of the yoke, wherein the first election element opposes the first housing section and the second ejection element opposes the second housing section, the first ejection element and the second ejection element each comprising;

a housing that defines a guide and a latching stop, a plunger having a latching nose and configured to move in the guide between at least aworking position, a locking position, and a rest position, wherein the plunger is restricted from moving in the guide in the locking position, and wherein the locking position is a position in which the ejection element does not impair movement of the flap into the closing position to accommodate installation of the flap on the vehicle body, a spring disposed in the housing and biased against the plunger in the working position and the locking position, and wherein the ejection element is oriented so that the flap moves the plunger from the rest position to the working position along a working direction when the plunger is in the rest position before a closing operation where the flap is moved from the opening position to the closing position, and wherein the locking position is accessible by extension of the plunger in the working direction beyond the working position, and wherein the spring biases the latching nose against the latching stop in the locking position of the plunger for a manual opening and a manual closing of the flap, and wherein the spring biases the plunger by a first amount in the locking position and biases the plunger and the flap by a second amount in the working position along the working direction, wherein the first amount is greater than the second amount.

2. The closing device according to claim 1, wherein the flap is a tailgate flap of a motor vehicle.

3. The closing device according to claim 1, further comprising a plurality of ejection elements.

4. The closing device according to claim 1. wherein the ejection element is symmetrically arranged with respect to the first closing element.

5. The closing device according to claim 1 wherein the plunger comprises a pressure surface configured to interact with opposite pressure surfaces on the flap side arranged symmetrically with respect to the second closing element.

6. The closing device according to claim 1, wherein the spring is a coil compression spring.

7. The closing device according to claim 1, wherein the plunger is rotatably received in the guide, and wherein the latching nose and the plunger housing are configured such that the plunger is latchable to the latching stop through a rotation of the plunger.

8. The closing device according to claim 7, wherein the latching nose is molded on the plunger, which is configured to move into a rotary position by turning the plunger, and wherein the latching nose engages into a latching clearance of the plunger housing.

9. The closing device according to claim 7, wherein the plunger is axially symmetrical.

10. The closing device according to claim 9, wherein the plunger is a cylindrical piston.

11. The closing device according to claim 7, wherein the plunger comprises a pressure surface configured to manually move in the locking position and rotating for latching with the latching stop.

12. The closing device according to claim 1, wherein the first closing element is configured to engage with the second closing element configured as rotatable catch.

13. The closing device according to claim 8, wherein the latching clearance is configured to form a latching seat that secures the latching nose against a second rotation out of the locking position.

14. The closing device according to claim 13, wherein the latching nose is received in a stroke clearance between the working position and the rest position upon moving of the plunger, and wherein the stroke clearance comprises a stroke stop configured to limit a stroke upon a pushing-out of the plunger.

* * * * *